US006263952B1

(12) United States Patent
Hunter

(10) Patent No.: US 6,263,952 B1
(45) Date of Patent: Jul. 24, 2001

(54) TRANSFER CONVEYOR FOR A SAND MOLD HANDLING SYSTEM

(75) Inventor: William A. Hunter, Naples, FL (US)

(73) Assignee: Hunter Automated Machinery Corporation, Schaumburg, IL (US)

( * ) Notice: Subject to any disclaimer, the term of this patent is extended or adjusted under 35 U.S.C. 154(b) by 0 days.

(21) Appl. No.: 09/144,500

(22) Filed: Aug. 31, 1998

(51) Int. Cl.[7] ..... B22D 33/00

(52) U.S. Cl. ..... 164/324; 164/323; 164/329; 164/193; 164/182

(58) Field of Search ..... 164/324, 323, 164/329, 193, 182

(56) References Cited

U.S. PATENT DOCUMENTS

| | | | | |
|---|---|---|---|---|
| 3,406,738 | | 10/1968 | Hunter | 164/182 |
| 3,506,058 | | 4/1970 | Hunter | 164/37 |
| 3,520,348 | | 7/1970 | Hunter | 164/193 |
| 3,612,159 | * | 10/1971 | Galinsky | 164/323 |
| 4,156,450 | | 5/1979 | Hunter | 164/24 |
| 5,022,512 | | 6/1991 | Hunter | 198/718 |
| 5,062,465 | * | 11/1991 | Mortensen | 164/323 |

* cited by examiner

*Primary Examiner*—Tom Dunn
*Assistant Examiner*—I.-H. Lin
(74) *Attorney, Agent, or Firm*—Leydig, Voit & Mayer, Ltd.

(57) ABSTRACT

A mold handling system for transferring molds from multiple feed lines to a single main conveyor. The present invention provides an improved and simplified system for transferring molds from several mold making machines to a single conveyor leading to a pouring station. Through the use of a transfer conveyor with cantilevered arms which intersect with the feed lines and the main line, molds can be transferred from the transfer conveyor to the main line by raising and lowering the cantilevered arms. A simplified mechanism for raising and lowering the transfer conveyor is provided in the form of an air actuated bellows apparatus. In order to provide lateral support to the transfer conveyor, brackets flank the bellows that are provided with a predetermined amount of lateral play to provide both the lateral support to the transfer conveyor, as well as enable the transfer conveyor to be raised and lowered.

23 Claims, 5 Drawing Sheets

TRANSFER CONVEYOR FOR A SAND MOLD HANDLING SYSTEM

FIELD OF THE INVENTION

The present invention generally relates to conveyors and more particularly relates to sand mold handling systems.

BACKGROUND OF THE INVENTION

Many metal castings are typically manufactured through a process wherein molten metal is poured into compressed sand molds, the metal cools and hardens, and the sand is broken away to retrieve the metal casting. In the context of automated foundries, a machine is typically provided wherein the sand molds are manufactured and carried via conveyors to a pouring station wherein the molten metal is introduced into the sand mold, and then the mold is traversed through various types of cooling conveyors until such time that the metal is hardened and the sand can be broken away.

Prior art systems for this purpose are well known, and disclosed in Hunter, U.S. Pat. No. 3,406,738 for "Automotive Matchplate Molding Machine"; Hunter U.S. Pat. No. 3,506,058 for "Method of Matchplate Molding"; Hunter U.S. Pat. No. 3,520,348 for "Fill Cartridges for Automatic Matchplate Molding Machines"; Hunter U.S. Pat. No. 4,156,450 for "Foundry Machine and Method and Foundry Mold Made Thereby"; and Hunter U.S. Pat. No. 5,022,512 for "Automatic Matchplate Molding System; the disclosure of each of which is expressly incorporated by reference.

In an effort to increase production, many foundries have found it advantageous to provide multiple mold making machines which simultaneously produce sand molds. Additional pouring stations can then be added to accommodate the increased number of molds. However, adding additional pouring stations necessarily increases capital investment costs, and some foundries therefore direct all of the sand molds from multiple mold making machines to a single mold handling line which can then direct the molds to the pouring station. Since the molds on the main mold handling conveyor are continuously advancing, mechanisms need to be provided to coordinate the transfer of the molds from the feed lines out of the mold making machines to the main mold handling line. Given the timing, weight, size and frequency of the molds, such mechanisms are currently complex, unreliable, and expensive.

This objective is complicated by the fact that the molds typically need to be aligned in end-to-end fashion on the main mold handling line. As a result, some foundries have employed the usage of turntables which rotate the molds after exiting the mold making machine, and prior to being placed on the main mold handling line. However, such turntables add substantial costs and complexity to the overall mold handling system.

SUMMARY OF THE INVENTION

It is an object of the present invention to provide a simplified mold handling system for transferring sand molds from multiple inputs to a single mold handling line.

It is another object of the present invention to provide a mold handling system with high productivity in that multiple molds are being made at the same time, while avoiding excessive capital investment in the multiple pouring stations, and associated hardware.

It is another object of the present invention to provide a mold handling system to transfer molds from various input feed lines parallel to a main mold handling line, without rotation.

In accordance with these objects, it is a feature of a preferred embodiment of the present invention to provide a transfer conveyor capable of selectively positioning molds carried on the transfer conveyor in a first direction onto a main conveyor traveling in a second direction orthogonal to the first direction. The transfer conveyor comprises a first end adapted to receive molds to be transferred, and a second end linearly opposite the first end, intersecting the transfer conveyor. The vertical position of the second end is selectively adjustable between a first position below the main conveyor such that the transfer conveyor has no effect on molds carried on the main conveyor, and a second position above the main conveyor such that a mold position on the second end is transferred to the main conveyor upon movement of the second end from the second position to the first position.

It is another feature of a preferred embodiment of the present invention to provide a mechanism for raising and lowering a transfer conveyor orthogonally disposed relative to a main conveyor wherein the mechanism includes a bellows actuator connected to the main conveyor and the transfer conveyor, and a loose-fitting hinge connecting the transfer conveyor to the main conveyor. Activation of bellows through introduction of air pressure causes the transfer conveyor to rise above the main conveyor, while deactivation of the bellows through release of air pressure causes the bellows to contract and the transfer conveyor to lower due to gravity. The hinge has a predetermined amount of play enabling the transfer conveyor to raise and lower relative to the main conveyor while maintaining proper lateral alignment of the transfer conveyor.

It is a still further feature of the present invention to provide the aforementioned hinge in the form of downwardly depending guide rods attached to the transfer conveyor, and apertured brackets attached to the main conveyor. The downwardly depending guide rods are matingly received into the apertures of the bracket with the diameter of the guide rods being less than that of the bracket apertures. Therefore, upon activation of the bellows actuator, the transfer conveyor is able to rise in an arc allowed by the play or give of the loose-fitting hinge.

These and other objects and features of the invention will become more apparent from the following detailed description when taken in conjunction with the accompanying drawings.

Figure 1:
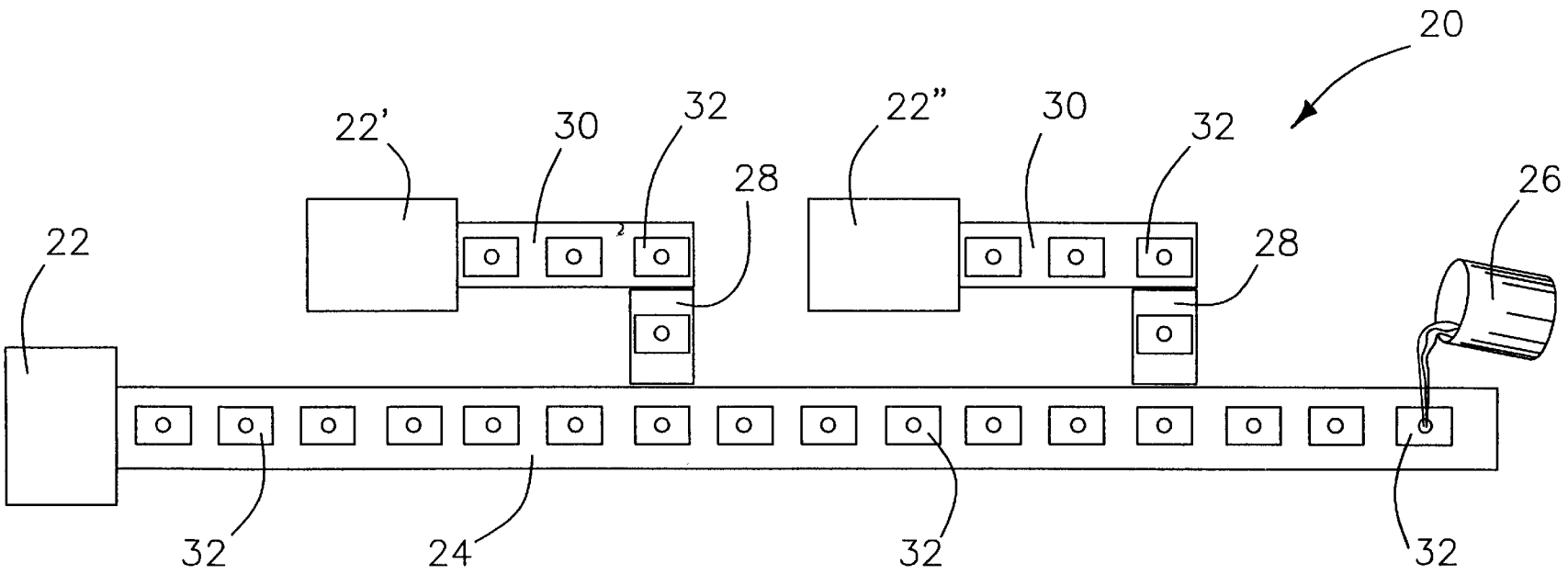
FIG. 1 is a schematic view of multiple mold making machines feeding a single conveyor leading to a pouring station.

While the invention is susceptible of various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention as defined by the appended claims.

DETAILED DESCRIPTION OF THE PREFERRED EMBODIMENT

Referring now to the drawings, and with particular reference to FIG. 1, the preferred embodiment of the present invention is generally depicted as mold handling system 20. In the schematic representation of FIG. 1 it can be seen that multiple mold making machines 22, 22' and 22" are provided to feed a single main conveyor 24 leading to a pouring station 26. It can therefore be seen that multiple mold making machines 22 can feed a single main conveyor 24 leading to a single pouring station 26, and thereby save on substantial capital investment costs associated with the main conveyor 24 and pouring station 26. Moreover, through the provision of multiple mold making machines 22, the productivity of the overall foundry can be dramatically improved. It is important to understand that the schematic depicted in FIG. 1 is but one embodiment employing the present invention. Other embodiments having a different number of mold making machines, conveyors and orientations are certainly possible under the scope of the present invention.

Figure 2:
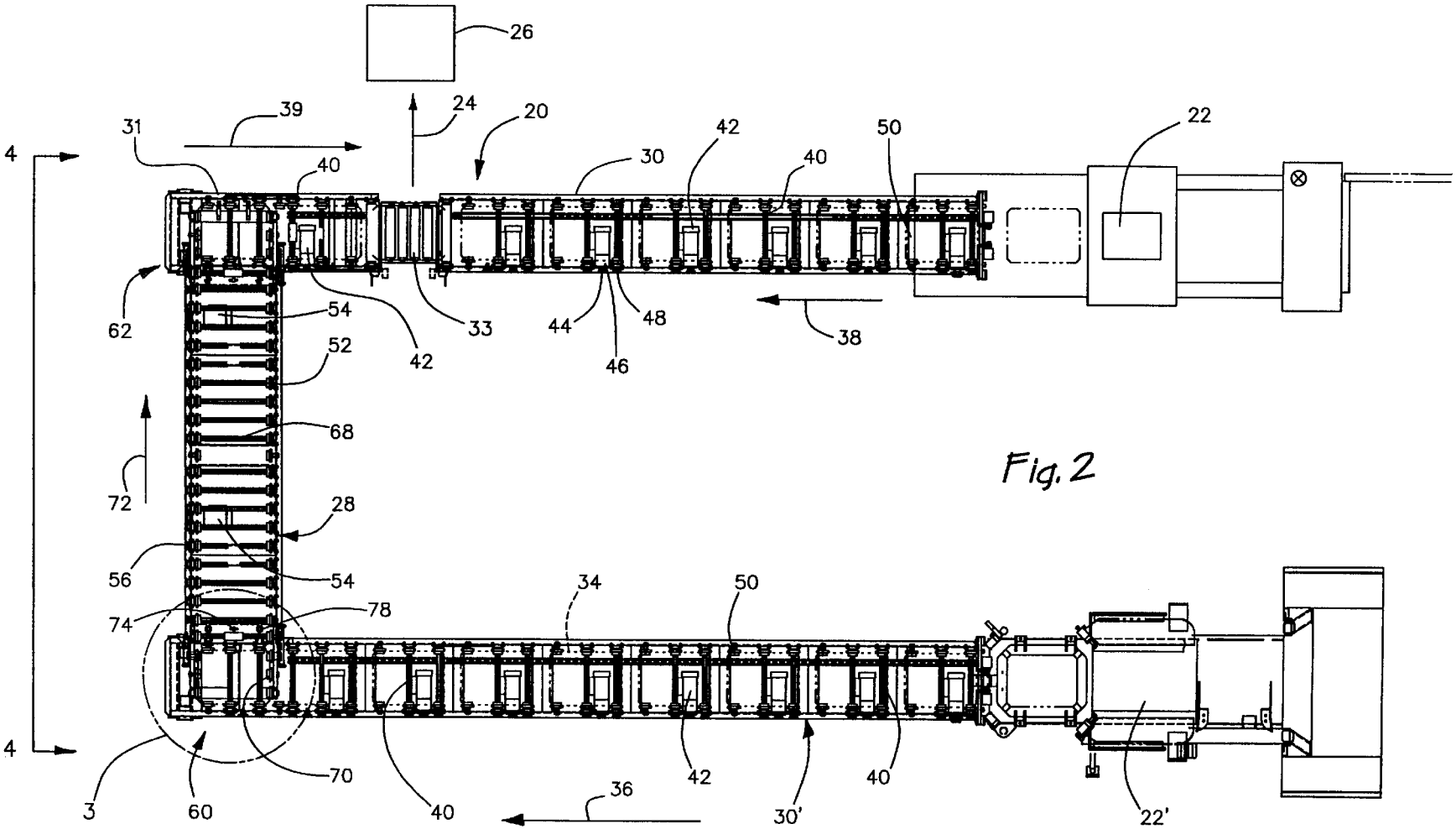
FIG. 2 is a top view of a preferred embodiment of the present invention.

For example, FIG. 2 shows another orientation, wherein transfer conveyor 28 is provided to transfer molds from input feed line 30' to shuttle conveyor 31, and ultimately to main conveyor 24. As shown in FIG. 2, molds from input feed line 30 travel parallel to shuttle conveyor 31 and intersect at loading zone 33 of main conveyor 24. Sand molds 32 exit mold making machine 22' on bottom boards 34 along input feed line 30' in a direction indicated by arrow 36. It can clearly be seen from FIG. 2, that input feed line 30' is parallel to, and travels in the same direction as, input feed line 30 which moves in the direction indicated by arrow 38. Shuttle conveyor 31, while parallel to feed lines 30 and 30' travels in the opposite direction, indicated by arrow 39. Through the provision of transfer conveyor 28, which is provided orthogonal to feed line 30' and shuttle conveyor 31, molds 32 can be transferred easily, reliably, and without any rotation. Molds from separate mold making machines 22 and 22' can therefore feed the same main conveyor 24 and pouring station 26. This eliminates the need for costly and complicated prior art mechanisms, including turntables employed by some prior art mold handling systems.

Before describing transfer conveyor 28 in further detail, it is first necessary to understand the manner in which the molds 32 are moved along the various conveyors. As shown best in FIG. 2, feed lines 30 and 30' as well as shuttle conveyor 31 include a plurality of driven rollers 40 which in the preferred embodiment are driven by electric motors 42 to which sprockets 44 are attached, with chains 46 being trained around sprockets 44 as well as around sprockets 48 attached to the end of each roller 40. As a control and cost savings measure, not every roller is driven in the preferred embodiment, and as shown in FIG. 2, idler rollers 50 are interspersed among sets of driven rollers 40. Although not depicted, main conveyor 24 can be similarly driven.

Therefore, sand molds 32 are moved along feed lines 30 and 30', as well as shuttle conveyor 31, by having driven rollers 40 engage bottom boards 34 upon which sand molds 32 rest. It is also important to understand at this point that a number of additional stations could be employed along with mold handling system 20, including a station to install weights and jackets about the periphery of sand mold 32 to provide additional structure prior to the introduction of molten metal from pouring station 26. However, for the sake of simplicity, and because such stations are not important for the function of the present invention, they are not depicted in the figures.

Figure 3:
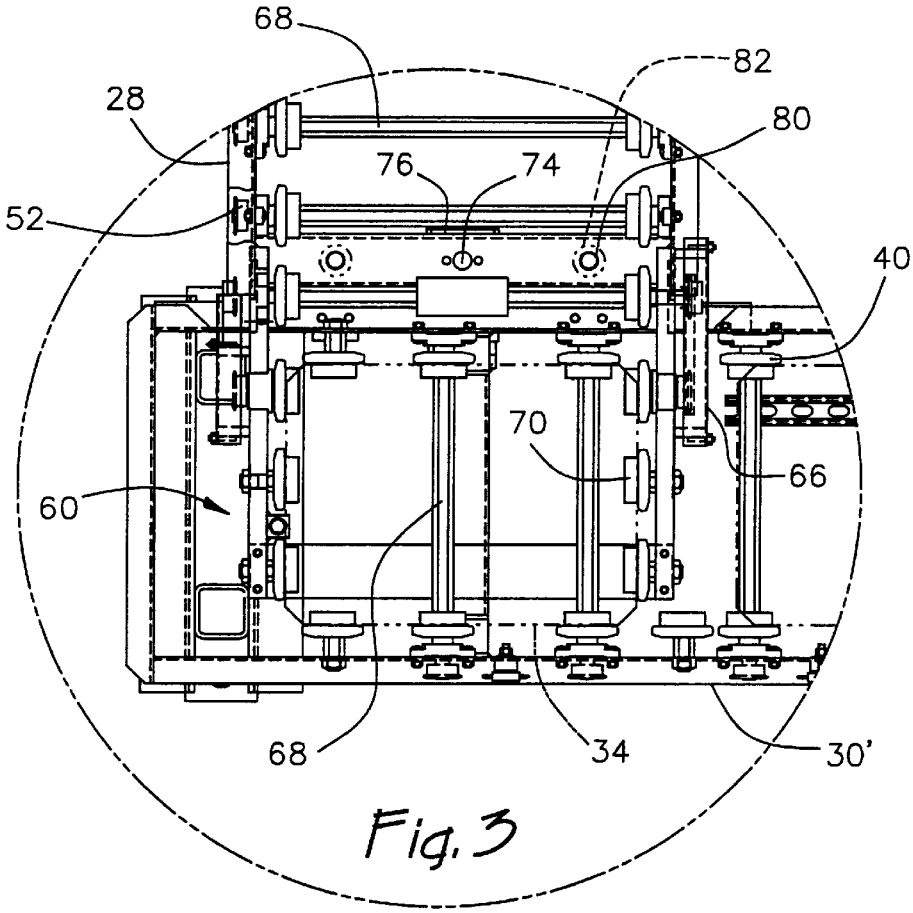
FIG. 3 is an enlarged top view of the intersection between the transfer conveyor and the shuttle conveyor encircled by line 3 in FIG. 2.
Figure 4:
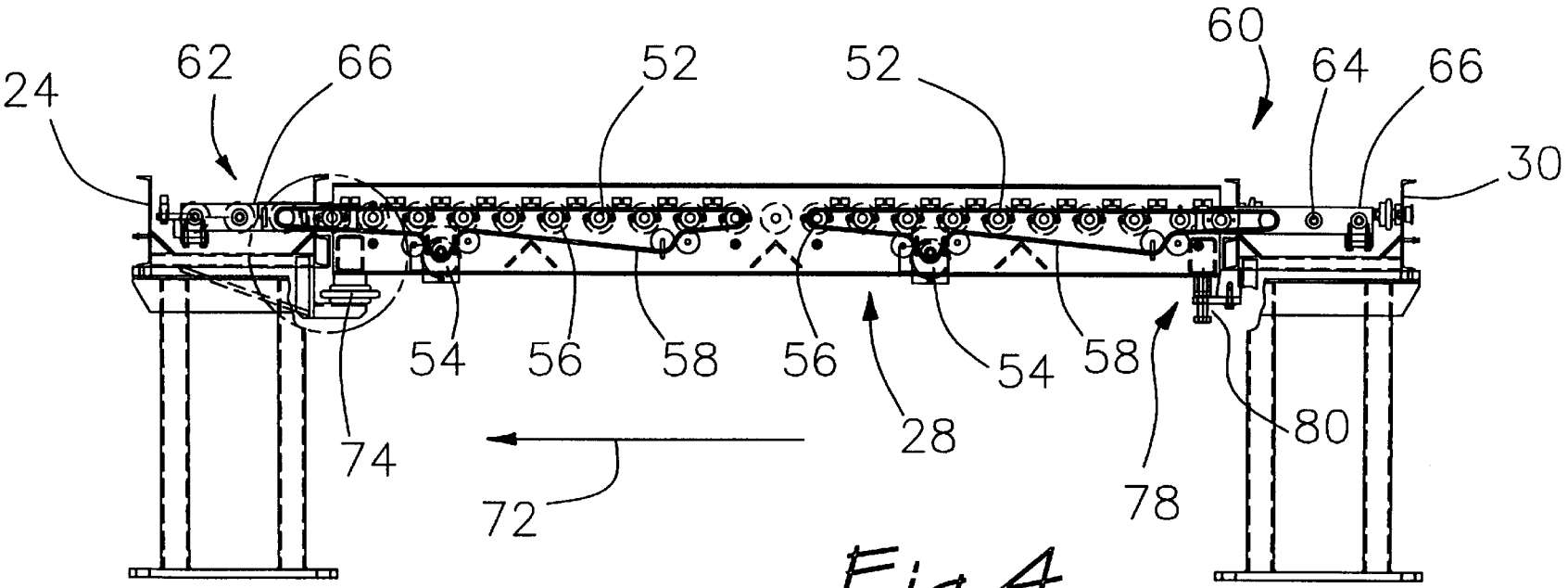
FIG. 4 is a side view of the transfer conveyor taken along line 4—4 of FIG. 2.

Upon reaching the end of feed line 30', molds 32 are transferred to transfer conveyor 28, and similarly, upon reaching the end of transfer conveyor 28, molds 32 are transferred to shuttle conveyor 31, both of which are performed without interfering with the motion of sand molds 32 along feed line 30' and shuttle conveyor 31, respectively. These functions are performed by transfer conveyor 28. Shown best in FIG. 4, transfer conveyor 28 also includes a plurality of driven rollers 52 which are powered by motor 54. In fact, in the embodiment shown in FIG. 4, two motors 54 are provided to which sprockets 56 are attached and around which chains 58 are trained. The chains are longer than those provided on feed lines 30 and 30' and extend across a larger number of driven rollers 52. However, one of ordinary skill in the art will readily recognize that the driven rollers are only provided in the intermediate sections of transfer conveyor 28, and that at first end 60 and second end 62, non-driven rollers 64 are provided. The importance and function of the non-driven or brake rollers 64 will be discussed with further detail herein, but at this point of the disclosure it is important to understand that not only are brake rollers 64 provided at the ends of transfer conveyor 28, but also that the ends of transfer conveyor 28 are provided in the form of cantilevered arms 66 which extend into the planes of input feed line 30' and shuttle conveyor 31. Transfer conveyor 28 is aligned such that cantilevered arms 66 do not interfere with driven rollers 40, but rather are provided parallel thereto in the intersections between transfer conveyor 28 and feed line 30', as well as transfer conveyor 28 and shuttle conveyor 31. Also, whereas driven rollers 52 of transfer conveyor 28 includes shafts 68 which extend between the rollers, only stub shafts 70 are provided on non-driven or brake rollers 64. This therefore enables first end 60 and second end 62 of transfer conveyor 28 to be raised and lowered relative to the feed line 30' and shuttle conveyor 31, respectively, and through the planes of driven rollers 40 without interference as best shown in FIG. 3.

It can therefore be seen that in operation, upon sand mold 32 reaching the end of input feed line 30', mold 32 will be disposed immediately over cantilevered arms 66. This motion is allowed since in a first position, cantilevered arms 66 are disposed below the plane of driven rollers 40 of feed line 30'. However, when the sand mold 32 does reach the end of input feed line 30', a suitable sensor such as a proximity switch is activated which causes the cantilevered arms 66 to raise to a second position wherein the plane of the cantilevered arms 66 is above the plane of the driven rollers 40. This tilting motion therefore transfers the sand mold 32 and bottom board 34 from the driven rollers 40 of feed line 30', to the first end 60 of transfer conveyor 28 on stub shafts 70.

In sequence with this motion, a signal is sent to motor 54 to energize and therefore cause driven rollers 52 to rotate and thereby move sand mold 32 in the direction indicated by arrow 72. Once the sand mold 32 is removed from the feed line 30', cantilevered arms 66 are again lowered to be below the plane of driven rollers 52 and thereby enable additional molds to be moved into the end position on input feed line 30'.

The process by which sand molds 32 are transferred from second end 62 of transfer conveyor 28 to shuttle conveyor 31 is quite similar. Normally, cantilevered arms 66 of transfer conveyor 28 at second end 62 are disposed below the plane of driven rollers 40 of shuttle conveyor 31. As a result, when cantilevered arms 66 are provided in this first position, sand molds 32 can traverse along shuttle conveyor 31 without interference from cantilevered arms 66. However, when a sand mold is ready to be transferred to shuttle conveyor 31, motor 54 is energized to thereby direct the sand mold 32 and its associated bottom board 34 to second end 62 of transfer conveyor 28. In this regard, non-driven or brake rollers 64 are used to suitably stop sand mold 32 and bottom board 34 at second end 62. Additional restraining means can be provided to ensure that sand mold 32 and bottom board 34 are stopped at second end, and properly positioned. In sequence, cantilevered arms 66 of second end 62 are raised such that non-driven rollers 64 are above the plane of driven rollers 40 of shuttle conveyor 31. In so doing, sand mold 32 and bottom board 34 are provided on second end 62 and are disposed immediately above shuttle conveyor 31. When cantilevered arms 66 of second end 62 are lowered to below the plane of driven rollers 40 of shuttle conveyor 31, sand mold 32 and bottom board 34 are necessarily transferred onto the driven rollers 40 of shuttle conveyor 31 at which point the sand mold 32 can be carried to loading zone 33 of main conveyor 24, and ultimately to pouring station 26.

Figure 5:
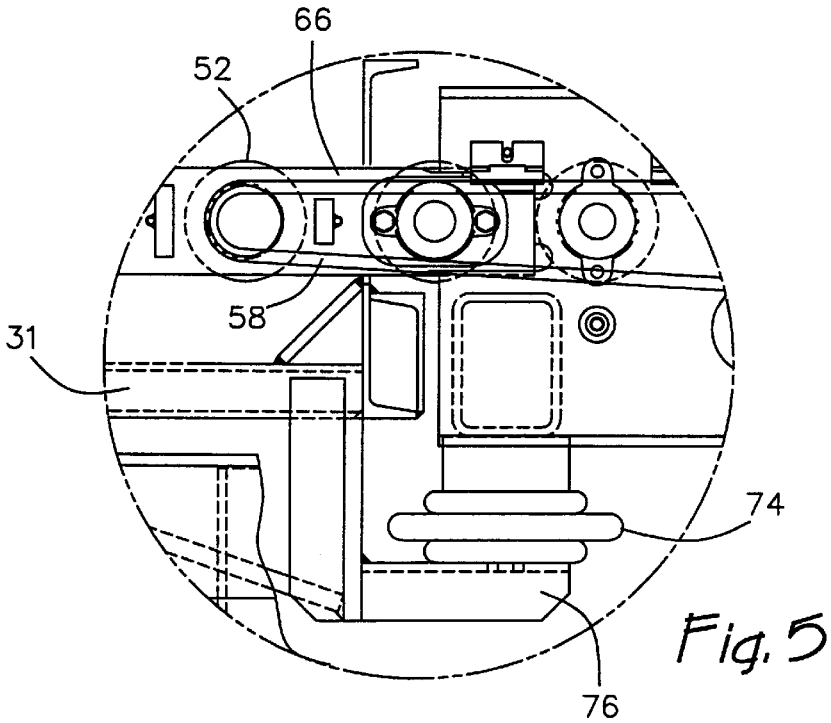
FIG. 5 is an enlarged side view of the end of the transfer conveyor and its attached bellows.
Figure 6:
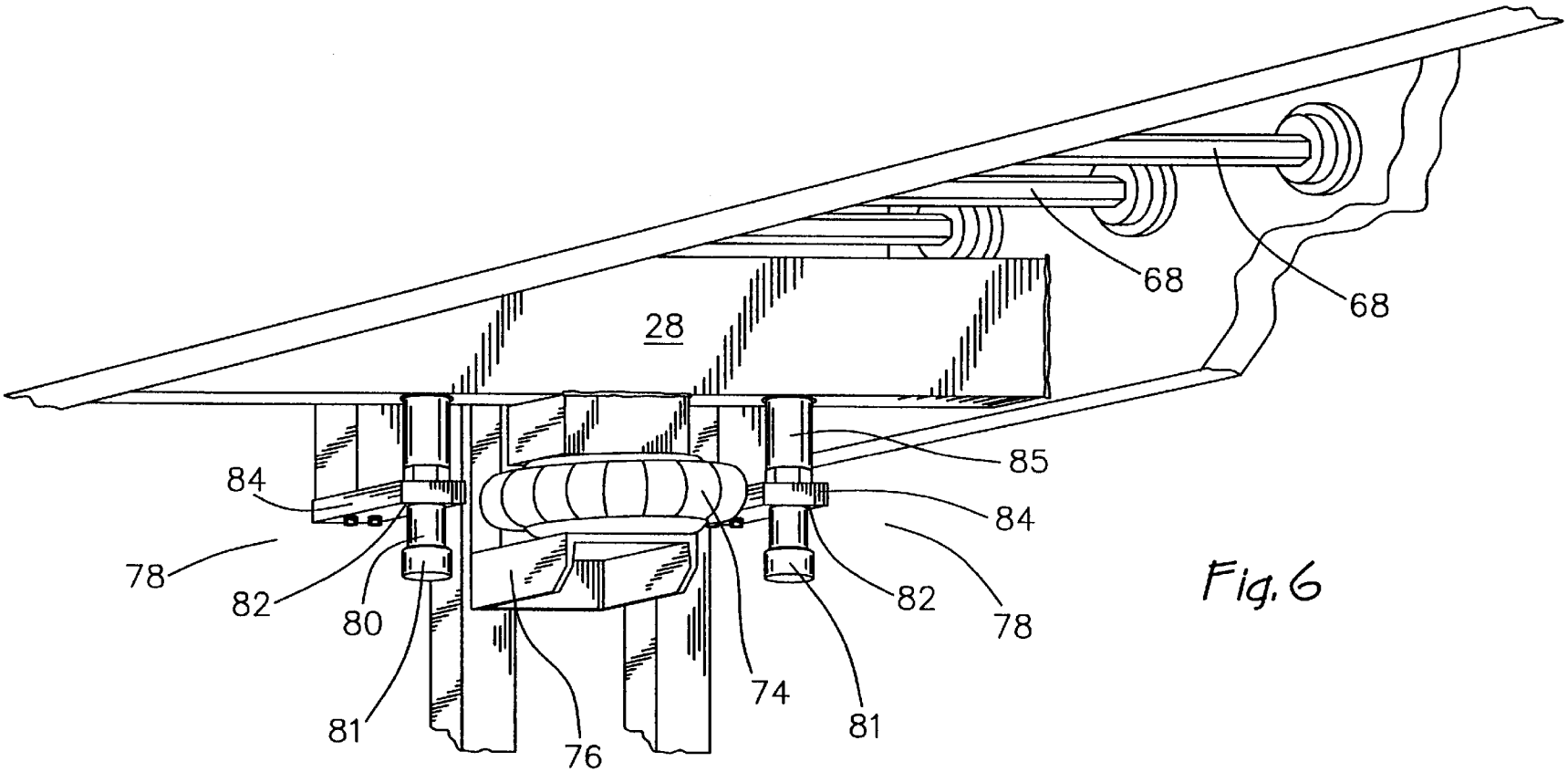
FIG. 6 is a perspective view of the bottom of the transfer conveyor, the bellows, and the lateral support brackets.

The manner in which the present invention is able to accomplish such movements is provided through the inventive features of transfer conveyor 28, as well as the mechanism which allows transfer conveyor 28 to be raised and lowered while still being connected to feed line 30' and shuttle conveyor 31. Turning now to FIGS. 5 and 6, the mechanism for raising and lowering transfer conveyor 28 is shown as bellows actuator 74. Actuator 74 is of the type having bellows which expand upon the introduction of air pressure and which contract upon the release of air pressure. In the preferred embodiment of the present invention, the bellows are in the form of a Firestone® Air Stroke® Actuator, model number W01-358-7731. The bellows type actuator are preferable in that they are self-aligning and thereby allow for a certain amount of lateral play without detrimental effect. However, other types of self-aligning actuators, including cylinders with trunnion mounts, are possible.

Bellows 74 are preferably situated upon support plate 76 which extends from, in the view shown in FIG. 5, the side of shuttle conveyor 31. The top of bellows 74 is then attached to the underside of transfer conveyor 28, as best shown in FIG. 6. A suitable source of compressed air is then connected to bellows actuator 74 and is electrically connected to a central processor to coordinate movement along with activation of driven rollers 40 and 52.

Since bellows 74 are centrally disposed at first end 60 and second end 62, a lateral support is provided to thereby limit the degree of lateral canting, and increase the stability of transfer conveyor 28. The lateral support needs to be sufficiently rigid to provide the necessary support against canting when one end of transfer conveyor is raised, while at the same time being sufficiently loose and have sufficient play to serve as a hinge point when the opposite side of transfer conveyor 28 is raised. In the preferred embodiment shown in FIGS. 5 and 6, the lateral support is provided in the form of loose-fitting hinge 78. Loose-fitting hinge is provided in the form of a pair of downwardly depending guide rods 80 connected to the underside of transfer conveyor 28. In the preferred embodiment each guide rod 80 is threadably attached to boss 85 for purposes which will be explained in further detail herein. Guide rods 80 are provided with a diameter of a known dimension, in the preferred embodiment being one inch in diameter. As can be seen in FIG. 6, guide rods 80 are actually matingly received through apertures 82 provided in flanking brackets 84 attached, in the embodiment shown in FIG. 6, to shuttle conveyor 31. Apertures 82 actually include a diameter slightly larger than the diameter of guide rod 80, in the preferred embodiment being of a diameter of 1.125 inches. This therefore allows for a known degree of lateral play or give which allows first end 60, as well as second end 62, to be raised and lowered as bellows 74 expands and contracts, while at the same time affording necessary lateral support to transfer conveyor 28 to ensure the stability of mold handling system 20. The degree, or arc, of travel through which first end 60, or second end 62, is able to travel is limited by the differential in size between the rods 80 diameter, and the bracket aperture 82 diameter. Guide rods 80 have a collar 81 on the bottom thereof to limit arcuate travel and thereby ensure guide rod 80 never fully escapes aperture 82.

While the preferred embodiment of the present invention includes such guide rods 80 and apertures 82, any type of loose-fitting hinge would be suitable if it would provide lateral support while still enabling first end 60 and second end 62 to be raised and lowered by bellows actuator 74. It is important to note however, that bellows 74 are not designed to be activated at both first end 60 and second end 62 at the same time, as lessened stability will result. This is due to the fact that once bellows actuator 74 is extended, guide rods 80 will necessarily contact the inner circumference of aperture 82 and collar 81 will engage bracket 84 to thereby hold that end in place. However, when both ends of transfer conveyor 28 are partially elevated with bellows actuator 74 partially extended, neither end is fixedly held in place due to the oversized nature of apertures 82 relative to the diameter of guide rods 80. Since actuator 74 is self-aligning and itself has a certain degree of lateral play, the stability of transfer conveyor 28 will be lessened. Stability occurs when either bellows actuator 74 is fully extended with guide rod collars 81 held against the underside of bracket 84, or when bellows actuators 74 is fully retracted with guide rod bosses 85 held against the topside of bracket 84.

It can therefore be seen by one of ordinary skill in the art, that the present invention provides a greatly improved and simplified system for handling molds and transferring molds from multiple feed lines to a single main conveyor leading to a pouring station. The invention enables the molds to be moved through the use of a transfer conveyor consisting of a cross-over unit between two parallel lines without the need for expensive and unreliable mechanisms such as turntables and without the need for excessive capital investment and redundant pouring stations. Multiple mold making machines can be provided to improve productivity, while a single main conveyor can be used to lead to a single pouring station. Moreover, through the novel features of the present invention, the transfer conveyor can remain in a lowered state to thereby allow the molds to traverse along the conveyor with which it intersects without interruption until a new mold is in position to be transferred.

What is claimed is:

1. A transfer conveyor capable of selectively positioning molds carried on the transfer conveyor in a first direction onto a second conveyor traveling in a second direction orthogonal to the first direction, the transfer conveyor comprising:

a first conveyor end intersecting an input feed conveyor to receive molds to be transferred; and a second conveyor end linearly opposite the first end and intersecting the second conveyor, the vertical position of the second conveyor end being selectively adjustable between a first position below the second conveyor such that the transfer conveyor has no effect on molds carried on the second conveyor, and a second position above the second conveyor such that a mold positioned on the second conveyor end is transferred to the second conveyor upon movement of the second conveyor end from the second position to the first position.

2. The transfer conveyor of claim 1 wherein conveyor end intersects the input feed conveyor parallel to the second conveyor, the vertical position of the first conveyor end being selectively adjustable between a first position below the input feed conveyor such that the second conveyor has no effect on molds carried on the input feed conveyor, and a second position above the input feed conveyor such that a mold positioned on the input feed conveyor above the first conveyor end is transferred to the transfer conveyor upon the first conveyor end moving from the first position to the second position.

3. The transfer conveyor of claim 1 wherein the transfer conveyor and second conveyor include a plurality of driven rollers and the molds are disposed on mold boards carried by the driven rollers.

4. The transfer conveyor of claim 3 wherein the second conveyor end includes a plurality of brake rollers, the driven rollers driving the molds to the second conveyor end, and the brake rollers stopping the molds on the second end prior to the second conveyor end moving from the second position to the first position.

5. The transfer conveyor of claim 4 wherein the driven rollers are powered by an electric motor, the electric motor being energized when moving a mold to the second conveyor end.

6. the transfer conveyor of claim 1 wherein the second conveyor end is attached to the second conveyor with a loose-fitting hinge having a predetermined amount of play, and the second conveyor end moves between the first and second positions via a bellows actuator.

7. The transfer conveyor of claim 6 wherein the loose-fitting hinge includes a pair of downwardly depending guide rods of a first diameter attached to the second end, and a mating bracket attached to the shuttle conveyor, the bracket having apertures of a second diameter, the second diameter being larger than the first diameter.

8. The transfer conveyor of claim 7 wherein the guide rods further included a collar below the bracket and a boss above the bracket to limit arcuate movement and increase stability of the transfer conveyor.

9. A transfer conveyor orthogonally disposed relative to a second conveyor, comprising:

a first conveyor end intercepting an input feed conveyor adapted to receive molds to be transferred;

a second conveyor end intersecting the second conveyor;

a bellows actuator connected to the second conveyor and the transfer conveyor, activation of the bellows causing the second conveyor end of the transfer conveyor to rise above the second conveyor, deactivation of the bellows causing the bellows to contract and lower the transfer conveyor; and a lateral support connecting the transfer conveyor to the second conveyor, the lateral support having a predetermined amount of play enabling the transfer conveyor to raise and lower relative to the second conveyor while maintaining proper lateral alignment of the transfer conveyor.

10. The mold transfer conveyor of claim 9 wherein the bellows are actuated upon introduction of air pressure causing the bellows to expand, and are deactivated upon release of air pressure causing the bellows to contract.

11. The mold transfer conveyor of claim 9 wherein the lateral support includes first and second guide rods downwardly depending from the transfer conveyor and flanking the bellows actuator, and first and second apertured brackets laterally extending from the second conveyor, the guide rods having a diameter smaller than the diameter of the bracket apertures, the guide rods being matingly received in the bracket apertures.

12. The mold transfer conveyor of claim 11 wherein the guide rods include a collar below the brackets and a boss above the bracket to limit arcuate travel and increase stability of the transfer conveyor.

13. A transfer conveyor for transferring molds between first and second conveyors in spaced apart relation, the mold transfer conveyor intersecting both of the first and second conveyors, the transfer conveyor comprising:

a first conveyor end extending horizontally into the first conveyor, the first conveyor end having a lowered position in which the first conveyor end is disposed beneath the first conveyor such that molds are adapted to be advanced on the first conveyor, and a raised position in which molds are adapted to be advanced on the transfer conveyor; and a second conveyor end opposite the first end and extending horizontally into the second conveyor, the second conveyor end having a lowered position in which the second conveyor end is disposed beneath the second conveyor such that molds are adapted to be advanced on the second conveyor, and a raised position in which molds are adapted to be advanced on the transfer conveyor.

14. The transfer conveyor of claim 13 further comprising a plurality of driven rollers for carrying the molds disposed on mold boards.

15. The transfer conveyor of claim 14 wherein the transfer conveyor includes only non-driven rollers at the first and second conveyor ends, and wherein the raised position of the first conveyor end tilts the transfer conveyor such that the first conveyor end is vertically above the second conveyor end whereby gravity is adapted to cause mold boards and their molds to roll onto the driven rollers of the transfer conveyor.

16. The transfer conveyor of claim 13 further comprising:

first and second loose-fitting hinges having a predetermined amount of play to allow the transfer conveyor to be tilted, the first loose fitting hinge connecting the transfer conveyor and the first conveyor; and the second loose fitting hinge connecting the transfer conveyor and the second conveyor; and first and second actuators connecting the transfer conveyor to the first and second conveyor, respectively, activation of the first and second actuators causing the first and second conveyor ends of the transfer conveyor to rise above the first and second conveyors, respectively, deactivation of the actuators causing the actuators to contract and lower the transfer conveyor.

17. The transfer conveyor of claim 16 further comprising first and second lateral supports connecting the transfer conveyor to the first and second conveyors, respectively, each lateral support having a predetermined amount of play enabling the transfer conveyor to raise and lower relative to the second conveyor while maintaining proper lateral alignment of the transfer conveyor.

18. The transfer conveyor of claim 16 wherein each loose-fitting hinge includes a pair of downwardly depending guide rods of a first diameter attached to the second end, and a mating bracket attached to the respective first or second conveyor, the bracket having apertures of a second diameter, the second diameter being larger than the first diameter.

19. The transfer conveyor of claim 16 wherein the actuators are of the bellows type.

20. A transfer conveyor for transferring molds on mold boards between first and second conveyors in spaced apart relation, the mold transfer conveyor intersecting both of the first and second conveyors, the transfer conveyor comprising:

a support frame having a plurality of rollers driven by a motor for carrying the mold boards;

a first cantilever arm extending horizontally from the support frame into the first conveyor, the first cantilever arm carrying a plurality of rollers;

a second cantilever arm extending horizontally from the support from into the second conveyor, the second cantilever arm carrying a plurality of rollers;

a first actuator connected to the first conveyor and the transfer conveyor, activation of the first actuator causing the rollers of the first cantilever arm of the transfer conveyor to rise above the second conveyor such that mold boards carrying molds are adapted to be advanced on the transfer conveyor, deactivation of the first actuator causing the actuator to contract and lower the rollers of the first cantilever arm below the first conveyor such that mold boards and molds are adapted to be advanced on the first conveyor; and a second actuator connected to the second conveyor and the transfer conveyor, activation of the second actuator causing the rollers of the second cantilever arm of the transfer conveyor to rise above the second conveyor such that mold boards carrying molds are adapted to be advanced on the transfer conveyor, deactivation of the second actuator causing the actuator to contract and lower the rollers of the second cantilever arm below the second conveyor such that mold boards and molds are adapted to be advanced on the second conveyor.

21. The transfer conveyor of claim 20 wherein the actuators are of the bellows type and further comprising:

first and second loose-fitting hinges having a predetermined amount of play to allow the transfer conveyor to be tilted, the first loose fitting hinge connecting the transfer conveyor and the first conveyor; and the second loose fitting hinge connecting the transfer conveyor and the second conveyor; and a lateral support connecting the transfer conveyor to the second conveyor, the lateral support having a predetermined amount of play enabling the transfer conveyor to raise and lower relative to the second conveyor while maintaining proper lateral alignment of the transfer conveyor.

22. The transfer conveyor of claim 20 wherein the cantilever arms of the carry only non-driven rollers, and wherein the raised position of the first cantilever arm tilts the transfer conveyor such that the first end is vertically above the second end whereby gravity is adapted to cause mold boards and their molds to roll onto the driven rollers of the transfer conveyor.

23. The transfer conveyor of claim 22 wherein the second cantilever arm carries a plurality of brake rollers, the driven rollers adapted to drive the mold boards and molds to the second end, and the brake rollers adapted to stop the mold boards.

* * * * *

UNITED STATES PATENT AND TRADEMARK OFFICE

CERTIFICATE OF CORRECTION

PATENT NO. : 6,263,952 B1
DATED : July 24, 2001
INVENTOR(S) : William A. Hunter

It is certified that error appears in the above-identified patent and that said Letters Patent is hereby corrected as shown below:

Claim 2,
Line 1, after "wherein", insert -- the first --

Claim 9,
Line 4, after "input feed conveyor", delete "adapted"

Signed and Sealed this

Twelfth Day of March, 2002

*Attest:*

*Attesting Officer*

JAMES E. ROGAN
*Director of the United States Patent and Trademark Office*